US010508407B2

(12) United States Patent
Kleber et al.

(10) Patent No.: US 10,508,407 B2
(45) Date of Patent: Dec. 17, 2019

(54) FRONT LOADER

(71) Applicant: Deere & Company, Moline, IL (US)

(72) Inventors: Simon Kleber, Buerstadt-Bobstadt (DE); Frederic Paillet, Gray (FR); Damien Faivre, Apremont (FR)

(73) Assignee: DEERE & COMPANY, Moline, IL (US)

( * ) Notice: Subject to any disclaimer, the term of this patent is extended or adjusted under 35 U.S.C. 154(b) by 516 days.

(21) Appl. No.: 15/222,111

(22) Filed: Jul. 28, 2016

(65) Prior Publication Data

US 2017/0089028 A1 Mar. 30, 2017

(30) Foreign Application Priority Data

Sep. 25, 2015 (DE) ..... 10 2015 218 524

(51) Int. Cl.
*E02F 3/36* (2006.01)
*E02F 3/34* (2006.01)

(52) U.S. Cl.
CPC . *E02F 3/36* (2013.01); *E02F 3/34* (2013.01)

(58) Field of Classification Search
CPC ..... E02F 3/34; E02F 3/36; E02F 3/369; E02F 3/422; E02F 3/6273; E02F 3/968
USPC ..... 37/444; 414/686
See application file for complete search history.

(56) References Cited

FOREIGN PATENT DOCUMENTS

| | | | | |
|---|---|---|---|---|
| DE | 102005053041 A1 | 5/2007 | | |
| EP | 1293611 A1 | 3/2003 | | |
| EP | 1389656 A1 * | 2/2004 | ..... | E02F 3/6273 |
| EP | 1389656 A1 | 2/2004 | | |
| WO | 2008/070901 A1 | 6/2008 | | |
| WO | WO-2008070901 A1 * | 6/2008 | ..... | E02F 3/34 |

OTHER PUBLICATIONS

European Search Report for Application No. 16188770.8 1712 dated Mar. 24, 2017.

* cited by examiner

*Primary Examiner* — Saul Rodriguez
*Assistant Examiner* — Brendan P Tighe
(74) *Attorney, Agent, or Firm* — Klintworth & Rozenblat IP LLP

(57) ABSTRACT

A tractor front loader (10) includes a parking stand device (28) mounted on a front loader arm (12). The parking stand device (28) comprises a parking support (30), which is pivotally attached to the front loader arm (12) and can be pivoted between an operating position (P1) and a parked position (P2), a locking brace (32), which is pivotally attached at one end to the front loader arm (12). Detent elements, which can be brought into engagement with one another, are disposed on the parking brace (30) and on a free end of the locking brace (32), by means of which the parking brace (30) can be snapped into multiple positions supporting the front loader, with the detent elements being formed on a free end of the locking brace (32) and on a locking carriage (58), which is hinged to the locking brace (32).

10 Claims, 7 Drawing Sheets

FRONT LOADER

RELATED APPLICATIONS

This application claims priority to DE Application No. 102015218524.9, titled Front Loader and filed 25 Sep. 2015, which is hereby incorporated by reference in its entirety.

TECHNICAL FIELD

The present application relates generally to front loaders and more particularly relates to parking stands for such loaders.

BACKGROUND

The use of front loaders for moving material using a tractor is known. For this purpose, front loaders can be mounted on or coupled to the tractor by means of a frame console provided on the tractor. The front loader usually has a lift arm assembly comprising a pair of transversely spaced, parallel lift arms, which are fixed together by a transverse torque tube and extend on the front end of the tractor, and are equipped with a suitable loading tool, for example a shovel, a gripper, a lifting fork, etc., wherein the lift arms and the front loader tool are usually actuatable by means of hydraulic or electric actuators. Parking stand devices can be provided on the lift arms of the front loader, which each comprise a parking support having an end pivotally coupled to the lift arm and can be pivoted into a parked position wherein it engages the ground or other support surface, in which said parking support can be locked. In the parked position, the front loader can be decoupled from the tractor and can be supported on the parking support surface in such a way that the lift arms are held in an upright coupling or decoupling position when the front loader is set down or parked, and so the front loader can be decoupled or coupled by releasing (or closing) the front loader locking mechanism and subsequently (or previously) simply manoeuvering the tractor.

A parking stand device of this kind is disclosed in WO 2008/070901 A1. The parking stand device disclosed there comprises a parking support, which is pivotably mounted on the arm of a front loader and can be pivoted out of an operating position (in which the front loader is coupled to the tractor) into a parked position (in which the front loader can be decoupled and set down or parked). An additional locking brace extends between the lift arm and the parking support and is mounted to the lift arm at one end so as to be pivotable relative to the lift arm and is guided at the other end so as to be displaceable along the parking support. The locking brace is furthermore connected to a locking bar, which extends along the parking support and implements a locking as soon as the parking support moves against a stop and reaches the parked position. A parking stand device of this kind is designed for an angular position—which can be preset and is nonetheless established—of the parking support with respect to the lift arm of the front loader, with the result that, given a constant presetting, the final parked position varies or is different depending on the tool coupled to the front loader or depending on irregularities in the ground. As a result thereof, after the front loader is decoupled, the front loader tilts into the parked position, which has been established by the presetting and set as a result of the tool and the ground conditions, and the interfaces on the front loader mast and on the vehicle frame can diverge in terms of the level thereof when coupled on again, which results in considerable manoeuvering work in order to couple the front loader. In addition, the aforementioned shape of the parking stand device is complex and has a great diversity of parts.

A further parking stand device is disclosed in EP 1 389 656 A1. Therein, a parking support having a locking brace extending between a front loader arm and a parking support is provided, wherein the parking support is provided with a snap-in tooth system and the locking brace is provided with complementary snap-in teeth on the free end. The snap-in teeth provided on the locking brace can be placed, via an actuating cylinder, in different positions on the snap-in tooth system and can be engaged therewith. As a result, an optimal angular position of the parking support with respect to the front loader lift arm can be set or the present circumstances with regard to the tool and the ground irregularities can be taken into account, and so the front loader also remains in the same parked position after the decoupling procedure, and therefore the height position of the interface on the front loader mast, when coupled again, is substantially unchanged from the height position during decoupling. The disadvantage in this case is that the snap-in tooth system and the snap-in teeth, in interaction with one another, engage into one another completely, i.e., over the full surface, only in an optimal locking position. Outside of this optimal locking position, the snap-in tooth system and the snap-in teeth engage into one another only over a portion of the surface or even only at points, whereby a high and, therefore, unfavourable, contact force on the snap-in teeth sets in, which can result in damage, on the one hand, or, on the other hand, requires a correspondingly high-strength and robust material formation.

The problem addressed by the invention is considered to be that of providing a variable parking stand device of the type mentioned at the outset, by way of which the aforementioned problems are overcome.

SUMMARY

Various aspects of examples of the disclosure are set out in the claims.

The problem is solved according to the invention by the teaching of claim 1. Further advantageous embodiments and refinements of the invention will become apparent from the dependent claims.

According to the invention, a front loader of the type mentioned at the outset is designed in such a way that the detent elements disposed on the free end of the locking brace are formed on a locking carriage, which is swivelably hinged to the locking brace. The arrangement of the detent elements on a swivelable locking carriage makes it possible for the detent elements to be oriented in an optimal manner with respect to one another, independently of an angular position of the parking support with respect to the front loader lift arm, by means of a corresponding swivel movement of the locking carriage; as a result, a minimization of the load on the detent elements, in particular a minimized contact pressure and minimized stress peaks on the detent elements, for any locking position, is made possible.

The parking support is designed as a guide channel having a U-shaped profile, wherein detent elements disposed on the parking support are located in the area of the web on the inside of the rail and wherein a guide rail is formed on the inside of each of the legs of the channel, by means of which the locking carriage is guided on its side facing the front loader lift arm, wherein the detent elements are formed on a side of the locking carriage facing away from the front loader lift arm. The guide rail can be designed as a guide edge or as a raised area on the inner sides of the legs. The guide rail is designed in such a way that the locking carriage remains in the channel and is guided within the channel. The channel and the locking brace are movably held together, and so pivoting the parking support or the channel causes the locking carriage to be displaced within the channel.

The detent elements formed in the area of the web of the parking support are designed as parallel rows of teeth disposed opposite one another at the leg sides of the web, wherein the rows of teeth face the side of the locking carriage facing away from the front loader lift arm and the locking carriage is displaceably guided between the guide rails and the rows of teeth. In other words, the rows of teeth face the detent elements on the locking carriage, since the latter are located on the side facing away from the front loader lift arm. The rows of teeth and the guide rails are spaced apart from each other in such a way that the locking carriage, in the engaged state, via its detent elements, can be released from or lifted off of the detent elements on the parking support (channel). In this way, an inner movement gap can form between the detent elements carried by the parking support and the matching detent elements carried by the locking carriage so that the locking carriage can be freely displaced along the guide rail.

The locking carriage can be designed as a one-part component or as a multiple-part component. For example, the locking carriage can be formed by two flat side parts, which are disposed parallel to one another, are connected to one another by a transverse brace, and are swivelably suspended on a transverse pin, which extends between the side parts and is pivotally connected to the free end of the locking brace, wherein the detent elements are each formed by a row of teeth disposed on an edge of the side parts facing away from the front loader lift arm. The side parts can be formed by flat panels or the like, wherein the side parts, when stood on their edge sides, face one another with their flat sides. The transverse brace is used in this case to rigidly connect the two side parts. The transverse pin is used for swivelably suspending the locking carriage on the free end of the locking brace, wherein corresponding transverse pin receptacles are formed on the two side parts. By means of the swivelable arrangement of the locking carriage, it is possible for rows of teeth formed on the locking carriage to always be oriented parallel to the row of teeth formed on the parking support, and so optimal surface coverage between the individual teeth of the rows of teeth is always ensured, thereby preventing stress peaks or excessive contact pressures on the tooth surfaces due to inadequate coverage of the tooth surfaces.

A spring-preloaded locking bar is formed on the parking support, which can be brought into engagement with a snap-in device formed on the front loader lift arm in order to lock the parking stand device in the operating position, wherein it extends upwardly along the back side of the loader lift arm from its pivotal connection with the lift arm. For this purpose, a simple latch or a projection can be disposed on the front loader lift arm, on which latch or projection the locking bar can snap into place or on which the locking bar can be retained by means of its spring preload as soon as the parking support has been pivoted into the operating position.

The invention as well as further advantages and advantageous refinements and embodiments of the invention are described and explained in greater detail in the following with reference to the drawings, which show an exemplary embodiment of the invention.

BRIEF DESCRIPTION OF THE DRAWINGS

The detailed description of the drawings refers to the accompanying figures in which.

DETAILED DESCRIPTION OF THE DRAWINGS

Figure 1:
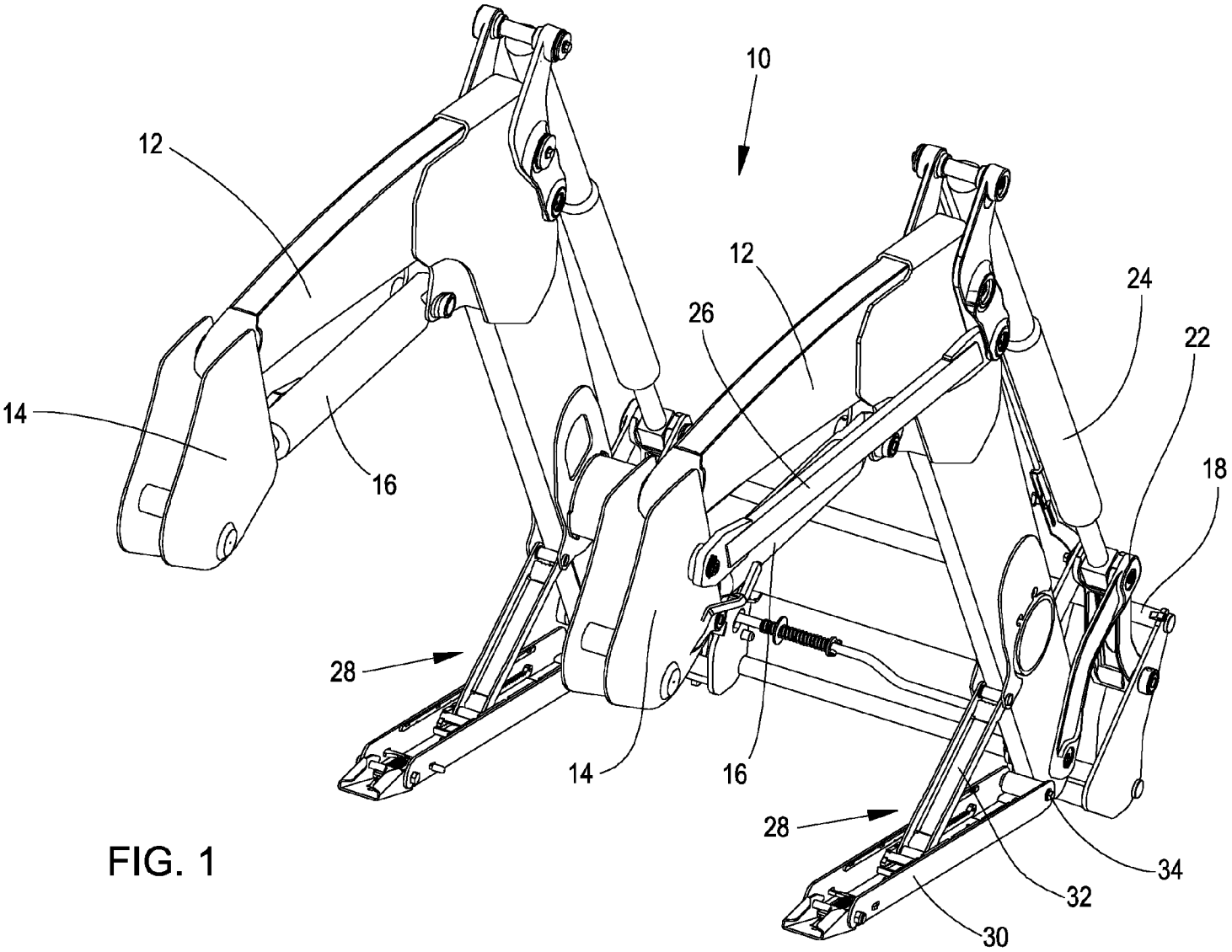
FIG. 1 shows a schematic right rear perspective view of a front loader comprising a parking stand device coupled to a lower region of the loader lift arm arrangement.

At least one example embodiment of the subject matter of this disclosure is understood by referring to FIGS. 1 through 7 of the drawings.

The front loader 10 comprises a front loader having a lift arm assembly comprising a pair of parallel, transversely spaced lift arms 12 joined together at a lower front region by a transverse toreque tube. The front loader 10 can be coupled to a vehicle by means of a mast assembly 14 and a console (not illustrated) fastened on the vehicle. Extending between each mast assembly 14 and the associated front loader lift arm 12 is an actuator 16, for example a hydraulic cylinder, for raising and lowering the front loader lift arm 12. Disposed on the lower front free end of the front loader lift arm 12 is a tool receptacle 18, which can accommodate an exchangeable front loader tool, for example a front loader shovel, a bale gripper, a forklift fork, etc. (not illustrated). The tool receptacle 18 and, therefore, a front loader tool can be pivoted relative to the front loader arm 12 by means of an actuating linkage 22 coupled between each arm 12 and the tool receptacle 18 and which can be controlled via a further actuator 24 coupled between each arm 12 and the adjacent linkage 22. A further linkage 26 coupled between each mast assembly 14 and a bell crank coupled between each arm and the associated actuator 24 is used for the parallel guidance of the tool receptacle 18 and a front loader tool when the front loader arm 12 is raised and lowered.

The front loader further comprises a parking stand device 28 disposed on each front loader arm 12, as is illustrated in greater detail in FIGS. 2 to 7.

Figure 2:
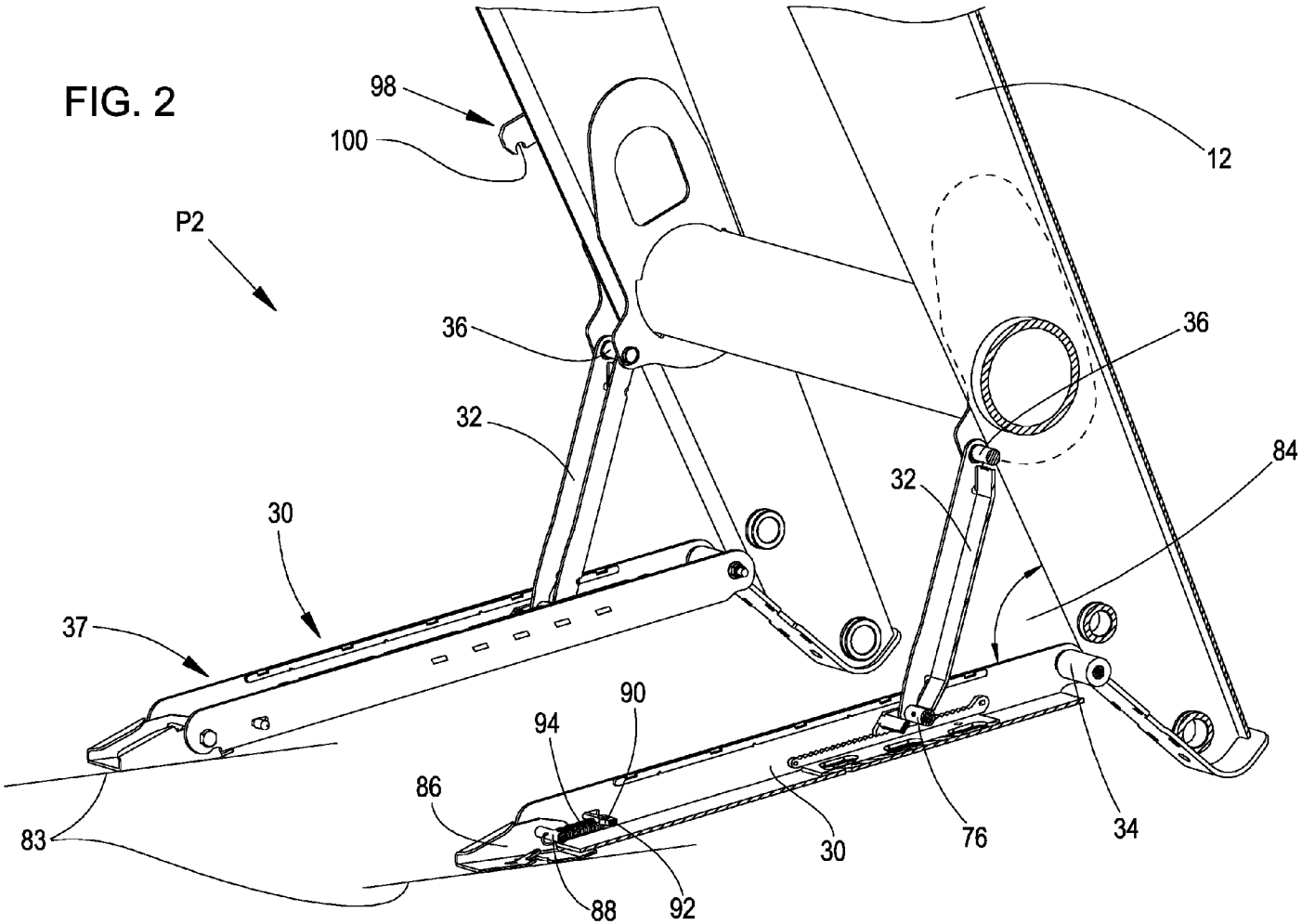
FIG. 2 shows a schematic right rear perspective view of an area of the parking stand device from FIG. 1, with the parking stand device in a parked position.

Each parking stand device 28 includes a parking support 30, which is hinged to the associated front loader arm 12 for pivoting vertically, and includes a locking brace 32, which is likewise pivotly hinged to the front loader arm 12 at one end and, at the other end, is additionally displaceably connected to the parking support 30. The locking brace 32 can be brought into a locked position (as illustrated in FIGS. 1 and 2) on the parking support 30, said brace assuming this position as soon as the parking support 30 is pivoted into a parked position, as is described in greater detail in the following. In the parked position or the locked position, the parking support 30 is supported and locked, with respect to the associated front loader arm 12, in a position predefined by the length and the swivel angle of the locking brace 32.

The parking support 30 is fastened at one end to the front loader arm 12 via a pivot pin 34 in a lower area of the free end of the front loader arm. Above the attachment of the parking support 30, the locking brace 32 is also fastened or hinged, at one end, to the front loader arm 12 by means of a pivot pin 36.

Figure 3:
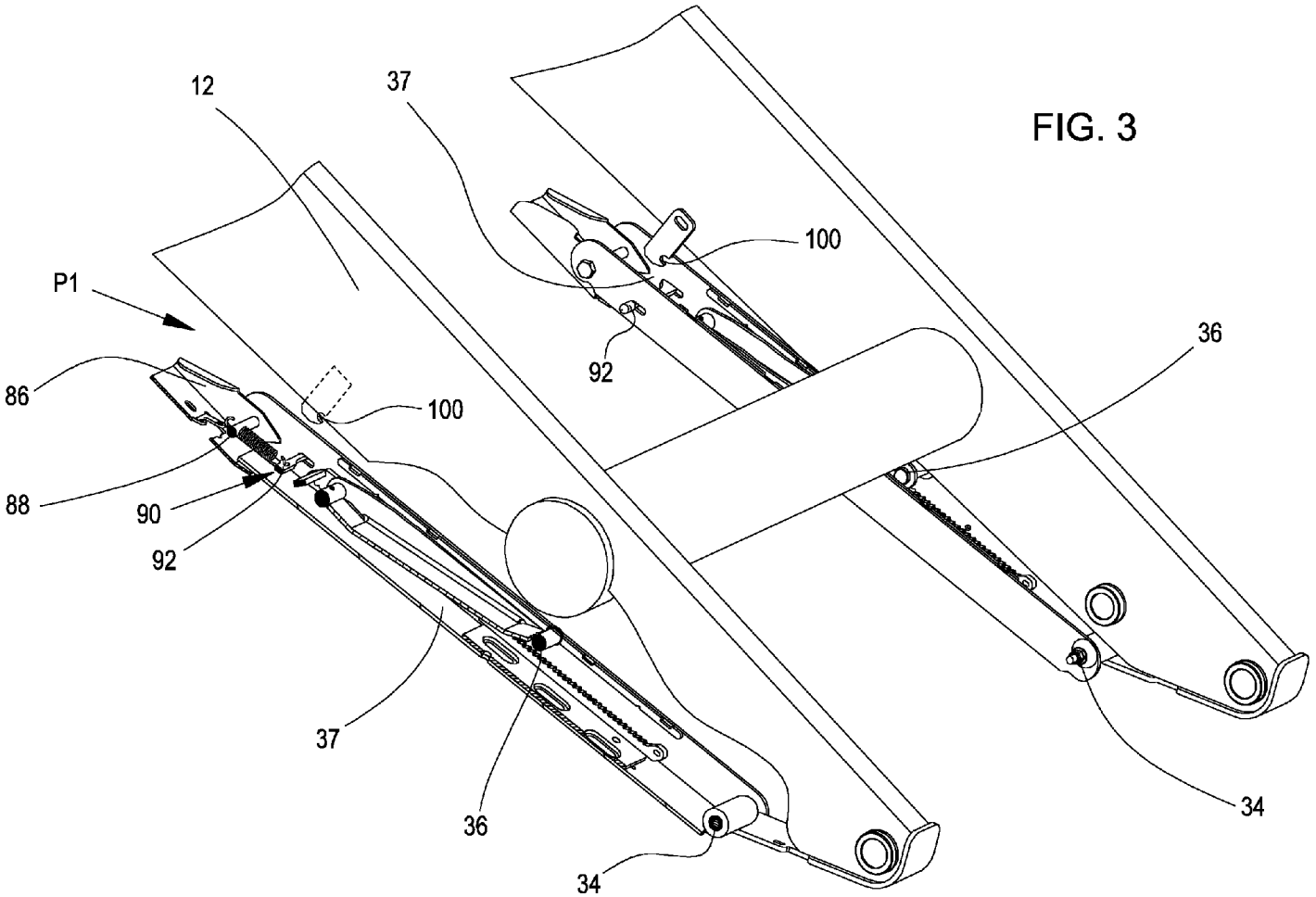
FIG. 3 shows a schematic right front perspective view of an area of the parking stand device from FIG. 1, with the parking stand device almost in an operating position.
Figure 4:
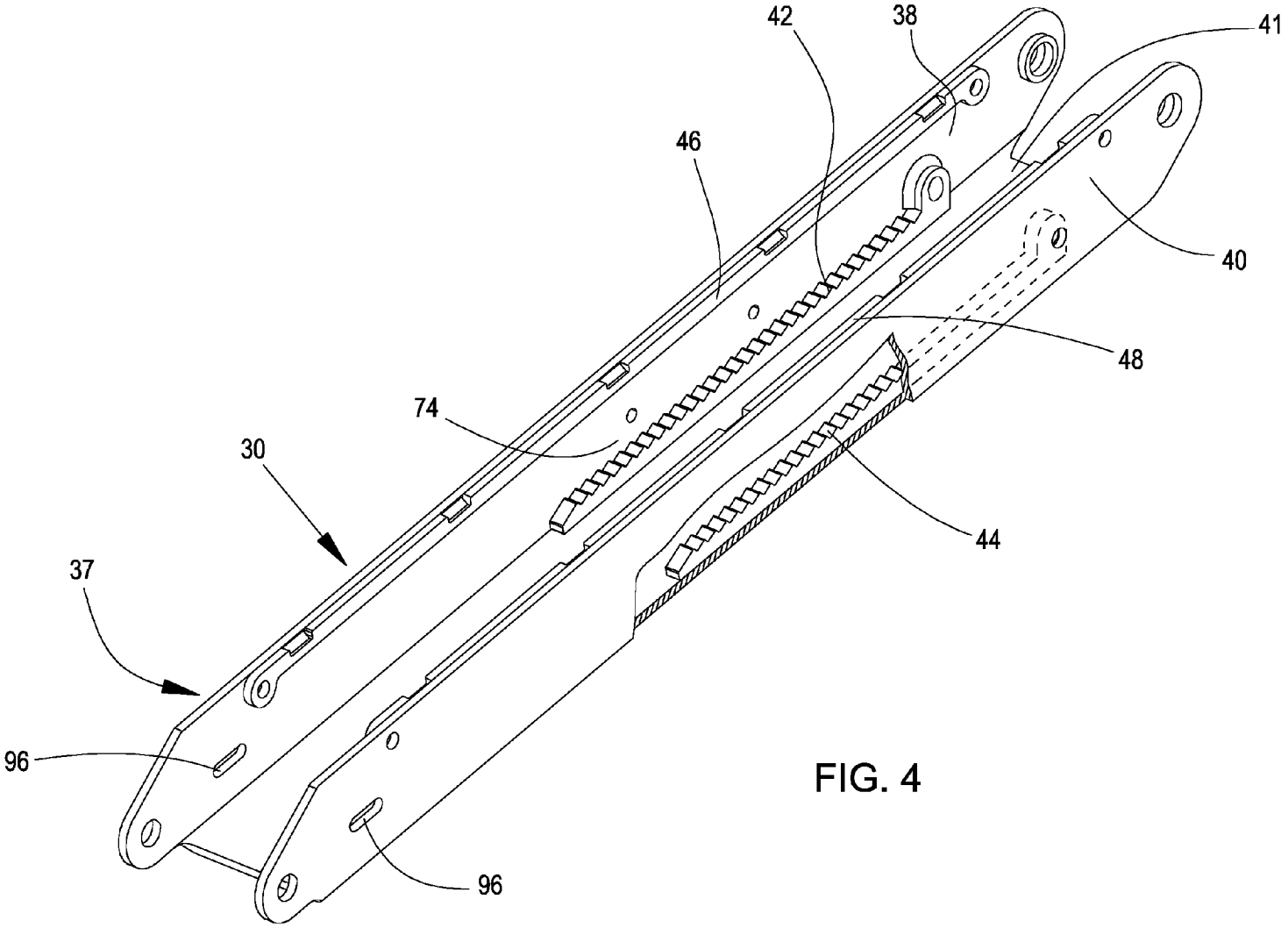
FIG. 4 shows a schematic top rear perspective view of one of the parking supports constructed as illustrated in FIGS. 1 to 3.
Figure 5:
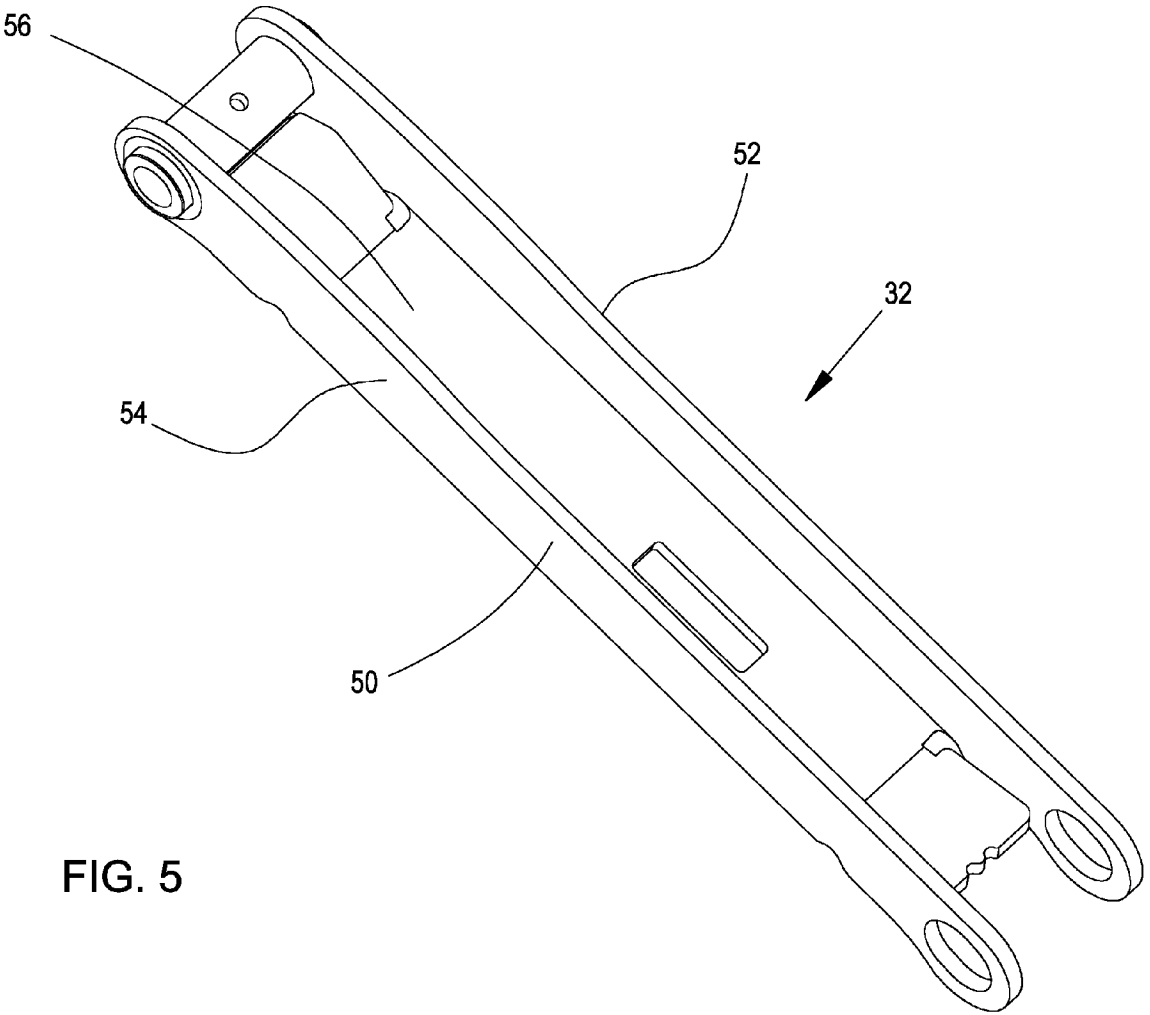
FIG. 5 shows a schematic top perspective view of one of the locking braces constructed as illustrated in FIGS. 1 to 3.
Figure 6:
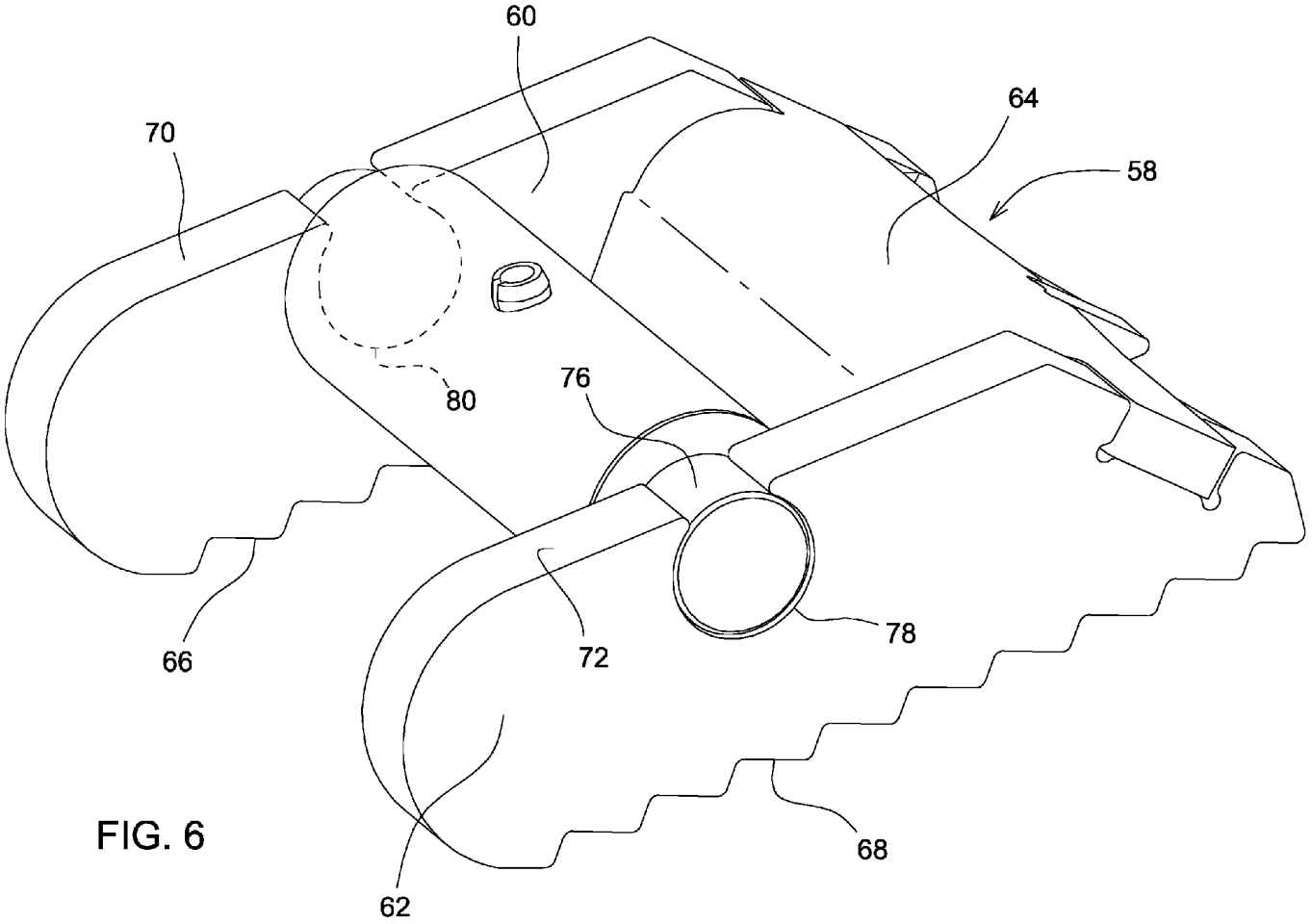
FIG. 6 shows a schematic perspective view of one of the locking carriages constructed as illustrated according in FIGS. 1 to 3.

The parking support 30 is designed as a channel 37 having a U-shaped profile and comprises two legs or side walls 38, 40, which extend in the direction of the front loader arm 12 and are connected to one another on the underside via a web 41 (in FIGS. 2 and 3, the parking support 30 at the front in each figure is depicted having only one side wall, in order to better show the parts located inside the channel 37). As is evident in FIG. 4 in particular, rows of teeth 42, 44 are disposed at the side walls 38, 40, on the inside thereof, respectively, on an area on the web 41, which rows of teeth are used as detent elements, which are disposed opposite each other on the web 41. The rows of teeth 42, 44, proceeding from approximately the center of the parking support 30, extend approximately two-thirds of the length of the half of the parking support 30 attached to the front loader arm 12. The channel 37 further comprises guide rails 46, 48 formed on the side walls 38, 40, each of which is disposed on the inside of an upper area of the channel 37, wherein the guide rails 46, 48 extend, centered along the length of the parking support 30, over approximately two-thirds the entire length of the parking support 30, and so the half of each of the guide rails 46, 48 closest to the front loader arm 12 are located directly above the rows of teeth 42, 44.

The locking brace 32 is also designed as a channel 50 having a U-shaped profile, and comprises two side walls 52, 54 connected to one another via a web 56. The side walls 52, 54 extend in the direction of the associated front loader arm 12 from the web 56 when the parking stand device 28 is close to its operating position P1, as shown in FIG. 3.

A locking carriage 58 is disposed on the end of the locking brace 32 opposite the end connected to the front loader arm 12. The locking carriage 58 is formed by two flat side parts 60, 62 or side panels, which are disposed on edge in parallel, spaced relationship to one another. The two side parts 60, 62 form a type of runner of the locking carriage 58. The side parts 60, 62 are rigidly connected to one another via a transverse brace 64, wherein the distance between the side parts 60, 62 is selected in such a way that the locking carriage 58 can be located between the side walls 38, 40 of the parking support 30 and moved or displaced lengthwise of the parking support 30. In this case, the side parts 60, 62 are placed via their upper smooth edges 70 and 72 on the undersides of the guide rails 46, 48, with the rows of teeth 66, 68 on the bottom edges of the side parts 60, 62 being disposed for being lowered onto the detent elements 42, 44 of the parking support 30 for locked engagement therewith, noting that the row of teeth 66, 68 are designed to be complementary to the rows of teeth 42, 44. Thus, the guide rails 46, 48 are used for guiding the locking carriage 58 along the guide rails 46, 48 when said carriage is moved out of an engaged position (in which the rows of teeth 42, 44 of the parking support 30 engage with the rows of teeth 66, 68 of the locking carriage 58) in a movement space 74 formed between the guide rails 46, 48 and the rows of teeth 42, 44 of the parking support 30.

The locking carriage 58 is pivotally suspended, by means of a transverse pin 76, on the end of the locking brace 32 opposite the end coupled to the front loader arm 12. The transverse pin 76 therefore connects the locking brace 32 to the locking carriage 58, which is displaceably guided in the parking support 30 and therefore movably connects the locking brace 32 and the parking support 30 to one another. The transverse pin 76 is enclosed in bearing holes 78, 80 formed in the side parts 60, 62, essentially centered between opposite ends of said side parts, and is rotatably connected to the locking brace 32. By means of an enabled swivel movement of the locking carriage 58, said carriage is capable of optimally orienting itself in all positions of the parking support 30, and so the rows of teeth 42, 44 and 66, 68 can optimally rest on one another or optimally engage into one another, and therefore, even in extreme positions of the parking support (a steep or flat position of the parking support 30), the entire lengths of the tooth surfaces 66, 68 of the locking carriage 58 can rest on the rows of teeth 42, 44 of the parking support 30 and, therefore, an optimal force distribution or a minimized contact pressure on the detent elements can be achieved.

An operating position P1 and a parked position P2 are defined for the parking stand device 28. In the operating position P1, both the parking support 30 and the locking brace 32 are swiveled or folded inward or are folded upward until they come to rest against the front loader arm 12 (see FIG. 3, in which the parking support is situated in an intermediate position shortly before being folded completely inward, i.e., the operating position P1 has been almost reached). The parking stand device 28 is preferably brought into the operating position P1 when the intention is to operate the front loader 10, i.e., said front loader has been coupled to a vehicle. In the parked position P2, however, (as illustrated in FIGS. 1 and 2), both the parking support 30 and the locking brace 32 have been swiveled or folded outward from the associated lift arm 12. The parking stand device 28 is preferably brought into the parked position P2 when the intention is to take the front loader 10 out of operation, i.e., to decouple the front loader from a vehicle and set it down or park it. Each of the positions which the parking stand device 28 assumes between the operating position P1 and the parked position P2 is an intermediate position.

Figure 7:
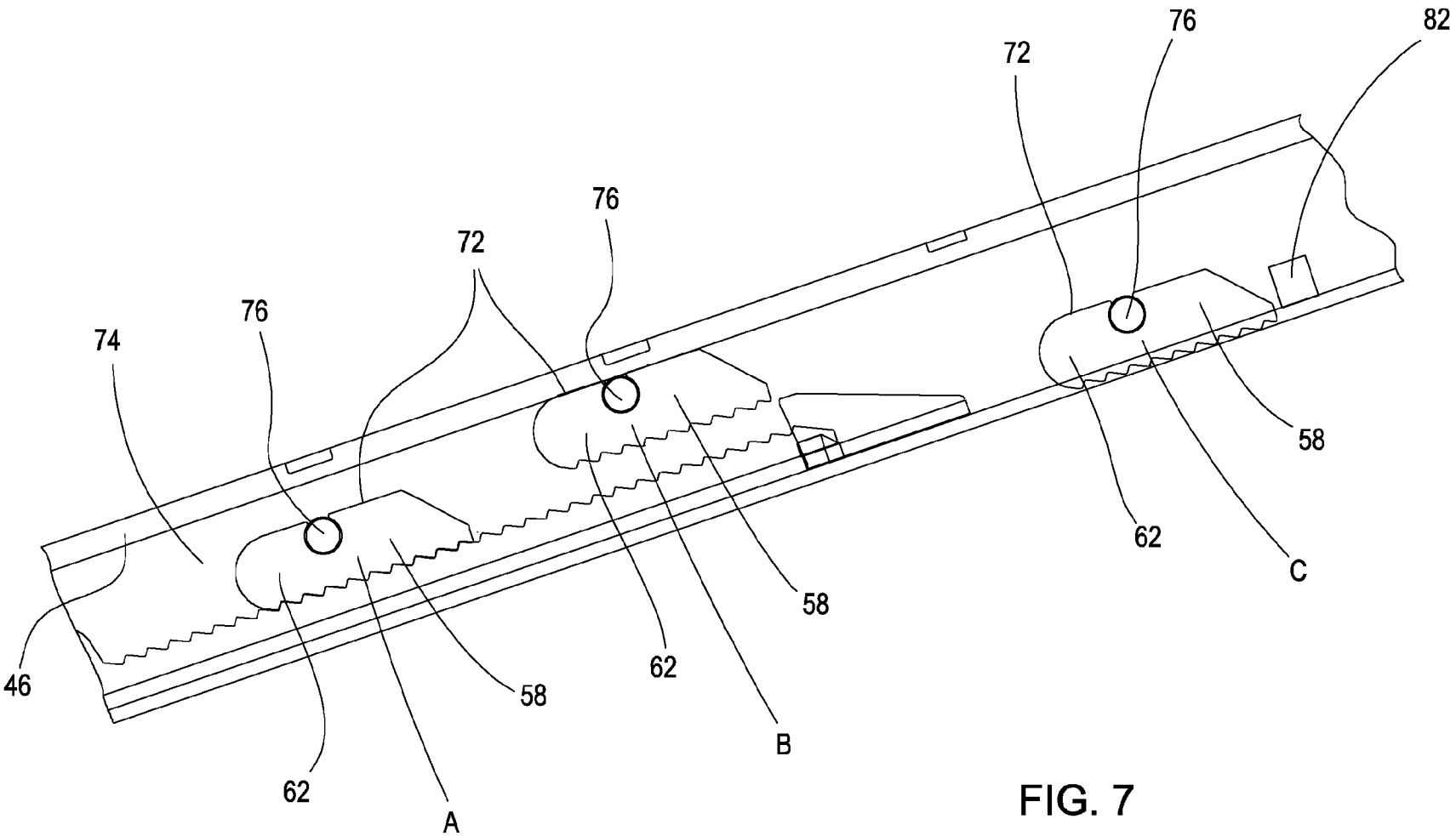
FIG. 7 shows a schematic, longitudinal sectional view of one of the parking supports together with the locking carriage shown in three possible positions including an engaged locking position, an elevated unlocked position against the guide rail and a position against the stop.

In FIG. 7, a longitudinal sectional view of the parking support 30 is shown together with the locking carriage 58 located in different positions along the length of the support 30. Specifically, the locking carriage 58 is shown in a locking position A, which is an example of a parked position P2, in which the teeth of the rows of teeth 42, 44 and 66, 68 are fully engaged with one another. B shows an intermediate position, in which the locking carriage 58 is shown raised in the intermediate space 74 created between the guide rails 46, 48 and the rows of teeth 42, 44 and in which the carriage 58 can be moved along the guide rails. As a result of a movement of the locking carriage 58 along the guide rails 46, 48, the locking carriage 58, released from the rows of teeth 42, 44, moves in the direction of the free end of the parking support 30, and therefore the parking support 30 can be swiveled toward the front loader arm and into the operating position P1. C is a stop position, which is outside the normal parked position P2 and in which the locking carriage 58 rests against a stop 82. This position is the flattest parked position that the parking stand device 28 can assume, with locking of the parking stand device being achieved by the carriage 58 abutting the stop 82.

Proceeding from the operating position P1, the locking carriage 58 rests stored at the free end of the parking support 30. If the parking stand device 28 is intended to be brought into a parked position P2, it is then folded outward or swiveled outward, with the locking carriage 58 passing through different positions along the guide rails 46, 48 until it, together with the rows of teeth 66, 68, is over the rows of teeth 42, 44 of the parking support 30. Due to the slope of the tooth flanks of the rows of teeth 44, 46 and 66, 68 relative to one another, the locking carriage 58 slides over the rows of teeth 44, 46 when the parking support 30 is swiveled outward, noting that the longitudinal extent of the rows of teeth 44, 46 on the web 41 is about three times greater than the longitudinal extent of the rows of teeth 66, 68 on the side walls of the locking carriage 58. As soon as the parking support 30 has been swiveled completely outward and impacts a support surface such as a floor 83 or ground and has a suitable parked position angle 84, the entire longitudinal extent of the rows of teeth 66, 68 of the locking carriage 58 find a position on a section of the longitudinal extent of the rows of teeth 44, 46 of the parking support 30 associated with this parked position angle 84 of the parking support 30, wherein, the more teeth there are, the finer the adjustment is. If the front loader 10 is then decoupled, a reverse flow of force sets in at the front loader arm 12, since the arm is now supported via a supporting force on the parking support 30 and, therefore, the locking brace 32 presses, with the locking carriage 58, onto the parking support 30 and onto the rows of teeth 42, 44 formed thereon. At the same time, the rows of teeth 66, 68 of the locking carriage 58 snap into engagement with the rows of teeth 42, 44 of the parking support 30 without the front loader 10 tilting backward, due to the finely toothed rows of teeth 44, 46 and 66, 68. In this case, due to the swivelable arrangement of the locking carriage 58, it is simultaneously ensured that the rows of teeth can engage into one another over their full surfaces and, therefore, in an optimal manner with respect to load, independently of the parking angle position 84 which sets in. The swivel movement of the parking support 30 can be carried out by an operator or can take place under the force of gravity due to the natural weight of the parking support.

As long as a supporting force acts upon the locking brace 32, the locking carriage 58 is fixed and held captive and the parking stand device 28 is locked in position. The parking stand device 28 is released from the parked position P2 by coupling the front loader 10 to a supporting vehicle, which supplies pressure fluid to the actuators 16, in a manner well known, for raising the front loader 10, thereby neutralizing the supporting force so that the locking brace 32 can be manually unlocked from the rows of teeth 42, 44 of the parking support 30, by way of the locking carriage 58 being moved against the guide rails 46, 48, by gently lifting the locking brace 32, with the brace 32 together with the locking carriage 58 then being moved or displaced in the direction of the free end of the parking support 30. The parking stand device 28 can thereby be pivoted into the operating position P1.

A swing foot 86 is pivotally mounted on the free end of the parking support 30 by means of a pin 88 so as to be capable of pivoting back and forth and providing a contact area or support surface when the parking stand device 28 is pivoted into the parked position P2.

Furthermore, a locking device 90 extends between the swing foot 86 and the locking brace 32. The locking device 90 comprises a lock 92, which is accommodated by the side walls 38, 40, extends through the side wall 38 so that it can be gripped in order to be actuated, and is preloaded by a spring 94, which extends between the lock 92 and the pin 88, in the direction of the free end of the parking support 30. The lock 92 is provided with movement play due to slots 96 formed in the side walls 38, 40. Furthermore, a snap-in device 98 in the form of a short strap including a edge defining a contact surface leading to a snap-in notch 100 is provided, the strap being fixed to the front loader arm 12 at a location placing the contact surface and notch 100 in a path of movement taken by the lock 92 when the parking support 30 moves from its parking position P2 to its operating position P1, with the contact surface contacting and shifting the lock 92 in the slots 96 against the spring pre-load just prior to the support 30 reaching the operating position such that, when the support 30 reaches the operating position P1, the lock 92 snaps into the snap-in notch 100 as a result of its spring preload and holds the parking stand device 28 in the operating position or locks said device in the operating position. Simply by actuating the lock 92 within the slot 96 counter to its spring preload (moving in the longitudinal direction of the parking support), the parking stand device 28 can be unlocked and brought into the parked position P2.

While the above describes an example embodiment of the present disclosure, this description should not be viewed in a limiting sense. Rather, there are several variations and modifications which may be made without departing from the scope of the present invention as defined in the appended claims.

What is claimed is:

1. A front loader (10) for a tractor, comprising at least one front loader lift arm (12) and a parking stand device (28) mounted on the lift arm (12) for parking the front loader (10) on a support surface, wherein the parking stand device (28) comprises an elongate parking support (30), which is vertically pivotally mounted at its forward end to a lower region of the front loader lift arm (12) and can be pivoted between raised operating position (P1), wherein it extends upwardly from its lower end in close adjacent relationship to the lift arm (12), and into a parked position (P2), wherein it extends rearwardly from its forward end and includes a rear end in contact with the support surface; the parking stand device (28) further comprises a locking brace (32), which is pivotally attached at one end to the front loader lift arm (12) at a location spaced upwardly from the forward end of the parking support (30), and detent elements including a first set (42) and (44) extending lengthwise along, and mounted to, the parking support (30), the detent elements including a second set (60 and 62) attached to a free end of the locking brace (32), with the first and second sets of detent elements being assigned to one another and can be brought into engagement with one another, whereby the second set of detent elements carried by the locking brace (32) can be snapped into the first set of detent elements carried by the parking support at selected multiple positions along the locking brace (32) for supporting the front loader; and the second set of detent elements (60 and 62) defining a portion of a locking carriage (58), with the locking carriage being swivelably hinged to the free end of the locking brace (32).

2. The front loader according to claim 1, wherein the parking support is designed as a channel (37) having a U-shaped profile defined by opposite upright side walls (38, 40) joined to a web (41), wherein the first set of detent elements (42, 44) mounted to the parking support (30) are located on an area of the web (41) inside of the channel (37) and wherein a guide rail (46) is formed on an upper inside location of each of the legs (38, 40) of the channel (37), by means of which the locking carriage (58) is guided on its side facing the front loader arm (12), wherein the detent elements are formed on a side of the locking carriage (58) facing away from the front loader arm (12).

3. The front loader (10) according to claim 2, wherein the detent elements formed on the area of the web (41) of the parking support (30) are designed as parallel rows of teeth (42, 44) disposed opposite one another adjacent the side walls (38, 40) of the channel (37), wherein the rows of teeth (42, 44) face the side of the locking carriage (58) facing away from the front loader arm (12) and the locking carriage (58) is displaceably guided between the guide rails (46, 48) and the rows of teeth (42, 44).

4. The front loader (10) according to claim 1, wherein the locking carriage (58) is formed by two flat, parallel side parts (60, 62), which are transversely spaced from one another, are rigidly connected to one another by a transverse brace (64), and are swivelably suspended on a transverse pin (76), which extends between the side parts (60, 62) and is connected to the free end of the locking brace (32), wherein the detent elements are each formed by a row of teeth (66, 68) disposed on an edge of the side parts (60, 62) facing away from the front loader arm (12).

5. The front loader (10) according to claim 1, and further including a spring-preloaded locking bar (92) mounted on the parking support (30) for movement against the spring pre-load between a latching position and an unlatched position; a snap-in device (98) including a notch (100) and a contact surface leading to the notch (100) and being mounted on the loader arm (12) at a location positioning the contact surface and notch (100) along a path of movement taken by the locking bar (92) when the parking support (30) is moved between the parking position (P2) and the operating position (P1), with the locking bar (92) engaging the contact surface and being shifted against the spring pre-load just before the parking support (30) reaches the operating position (P1) and with the locking bar (92) snapping into the notch (100) when the parking support (30) reaches the operating position (P1) in order to lock the parking stand device (28) in the operating position (P1).

6. A combination of a loader lift arm assembly and a parking stand arrangement comprising:

said loader arm assembly including a parallel pair of transversely spaced loader lift arms having forward portions which are inclined downwardly and forwardly when the loader assembly is in a lowered condition;

said parking stand arrangement including a parking stand associated with the forward portion of each loader lift arm and including an elongate parking support and an elongate locking brace;

said parking support having one end pivotally mounted to a lower rear region of the associated lowered forward portion of the loader lift arm and having an opposite free end, with the parking support thus being mounted for pivotal movement between a lowered parking position, wherein the parking support extends rearwardly from the forward portion of the loader lift arm, and a raised operating position, wherein the parking support extends upwardly adjacent to, and behind the forward portion of the loader lift arm, and said parking support being provided with a first set of locking detent elements that project toward the forward portion of the loader lift arm when the parking support is in its operating position;

said locking brace having one end pivotally mounted to a rear region of the associated lowered forward portion of the loader lift arm at a location above the one end of the parking support and having an opposite free end; and a locking carriage being pivotably mounted to the free end of the locking brace and being provided with a second set of detent elements having a fore-and-aft extent as a group which is less than a fore-and-aft extent of the first set of detent elements as a group, with the second set of detent elements being respectively arranged for locked engagement, as a group, with the first set of detent elements carried by the parking support when the parking support is lowered to a parking position and the free end of the locking brace is lowered together with the locking carriage so as to prevent upward movement of the parking support toward said operating position against weight forces of the loader lift arm assembly.

7. The combination, as defined in claim 6, wherein the elongate parking support is a channel member having opposite side walls joined by a web, with the first set of detents being in the form of parallel, first and second rows of teeth extending longitudinally of, and being respectively located on opposite sides of the web at locations adjacent the opposite side walls.

8. The combination, as defined in claim 7, wherein the locking carriage includes opposite, parallel side walls, with said second set of detent elements being respectively defined by first and second rows of teeth formed on longitudinally extending edges of the side walls.

9. The combination, as defined in claim 6, wherein the pivotal connection of the locking carriage with the parking support is located approximately half-way between fore-and-aft spaced ends of the locking carriage, and wherein the fore-and-aft extent of said second set of detents is approximately equal to the distance between the fore-and-aft spaced ends of the locking carriage.

10. The combination, as defined in claim 9, wherein the locking carriage includes opposite, parallel side walls, with said second set of detent elements being respectively defined by first and second rows of teeth formed on longitudinally extending edges of the side walls.

* * * * *